US009548558B1

(12) United States Patent
Hsu et al.

(10) Patent No.: US 9,548,558 B1
(45) Date of Patent: Jan. 17, 2017

(54) ELECTRICAL CONNECTOR ASSEMBLY

(71) Applicant: Cheng Uei Precision Industry Co., Ltd., New Taipei (TW)

(72) Inventors: Li Nien Hsu, New Taipei (TW); Chih Lin Yang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 15/235,350

(22) Filed: Aug. 12, 2016

(51) Int. Cl.
*H01R 13/52* (2006.01)
*H01R 24/00* (2011.01)
*H01R 13/405* (2006.01)

(52) U.S. Cl.
CPC ..... *H01R 13/5221* (2013.01); *H01R 13/405* (2013.01); *H01R 13/5205* (2013.01); *H01R 24/005* (2013.01)

(58) Field of Classification Search
CPC .. H01R 13/5202; H01R 13/502; H01R 25/003
USPC ..... 439/277, 278, 281, 282, 587, 606
See application file for complete search history.

(56) References Cited

U.S. PATENT DOCUMENTS 7,833,057 B1 * 11/2010 Yang ..... H01R 13/65802 439/607.4
8,974,252 B1 * 3/2015 Yang ..... H01R 24/60 439/676
2016/0072244 A1 * 3/2016 Tien ..... H01R 13/52 439/18
2016/0181752 A1 * 6/2016 Parks ..... B60R 16/02 439/517
2016/0197437 A1 * 7/2016 Reeves ..... H01R 13/52 439/95

* cited by examiner

*Primary Examiner* — Phuongchi T Nguyen
(74) *Attorney, Agent, or Firm* — Lin & Associates Intellectual Property, Inc.

(57) ABSTRACT

An electrical connector assembly includes a plug connector and a receptacle connector. The plug connector includes a first insulating body, a sleeve barrel and a spring. The first insulating body defines a first sliding slot penetrating a front surface thereof. The sleeve barrel is worn outside the first insulating body. The spring is disposed between the sleeve barrel and the first insulating body. A slider block is protruded from a front portion of an inner surface of the sleeve barrel, the slider block is capable of sliding in the first sliding slot. The receptacle connector includes a second insulating body. The second insulating body defines a second sliding slot corresponding to the first sliding slot which includes a longitudinal part penetrating a rear surface of the second insulating body and an inclined part extending sideward and inclining frontward from a front end of the longitudinal part.

17 Claims, 6 Drawing Sheets

ELECTRICAL CONNECTOR ASSEMBLY

BACKGROUND OF THE INVENTION

1. Field of the Invention

The present invention relates to a plug connector, a receptacle connector and an electrical connector assembly, and more particularly to an electrical connector assembly which can improve the convenience for the users greatly.

2. The Related Art

A conventional electrical connector assembly includes a plug connector and a receptacle connector. The plug connector includes a first insulating body, a first mating port and a first shielding shell. The first mating port is fixed in the first insulating body. The first shielding shell is looped from a metal plate to enclose the first insulating body. The receptacle connector includes a second insulating body and a second mating port. The second mating port is fixed in the second insulating body. The first mating port and the second mating port are coupled to each other so as to electrically connect the plug connector and the receptacle connector.

However, in using process, the plug connector is easy to slide relative to the receptacle connector. In addition, the conventional electrical connector assembly usually has not a good waterproof function. In order to solve the problem, an improved plug connector, an improved receptacle connector and an improved electrical connector assembly are required.

SUMMARY OF THE INVENTION

An object of the present invention is to provide an electrical connector assembly. The electrical connector assembly includes a plug connector and a receptacle connector. The plug connector includes a first insulating body, a sleeve barrel and a spring. The first insulating body includes a cylinder shaped base body and an extending portion protruded rearward from a middle of a rear surface of the base body. An outer periphery of the base body defines a first sliding slot penetrating a front surface of the base body. A stopping portion is extended outward from a front portion of a bottom of the first sliding slot. The sleeve barrel includes a barrel body and a barrel end board, the barrel end board is arranged at a rear end of the barrel body. The barrel end board defines a penetration hole, the sleeve barrel is worn outside the first insulating body, the extending portion is received in the penetration hole. A slider block is protruded from a front portion of an inner surface of the barrel body corresponding to the first sliding slot. The slider block is capable of sliding in the first sliding slot to pass from and be located in front of the stopping portion. The spring is worn outside the extending portion, one end of the spring abuts against a rear surface of the base body, the other end of the spring abuts against the barrel end board. The receptacle connector includes a second insulating body. The second insulating body includes a cylinder shaped rear end portion which defines a second sliding slot corresponding to the first sliding slot of the first insulating body. The second sliding slot includes a longitudinal part with a rear end penetrating a rear surface of the rear end portion and an inclined part extending sideward and inclining frontward from a front end of the longitudinal part. The first sliding slot of the first insulating body and the second sliding slot of the second insulating body are connected each other, the sleeve barrel moves towards the receptacle connector, the slider block of the sleeve barrel moves towards the second sliding slot, then, the sleeve barrel is rotated in clockwise direction until the slider block is locked in a distal end of the second sliding slot, the spring is compressed by the barrel end board.

As a improvement, the receptacle connector further includes a waterproof ring mounted on the rear end portion of the second insulating body and located in front of the second sliding slot, when the slider block is locked in the distal end of the second sliding slot, a front surface of the barrel body is against the waterproof ring.

As described above, the slider block of the sleeve barrel moves in the first sliding slot, the connecting groove and the second sliding slot to lock or unlock the receptacle connector. Thererfore, the electrical connector assembly can improve the convenience for use. In addition, in a locked state, the front surface of the barrel body is against the waterproof ring tightly so as to make the electrical connector assembly have a good waterproof function, indeed.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
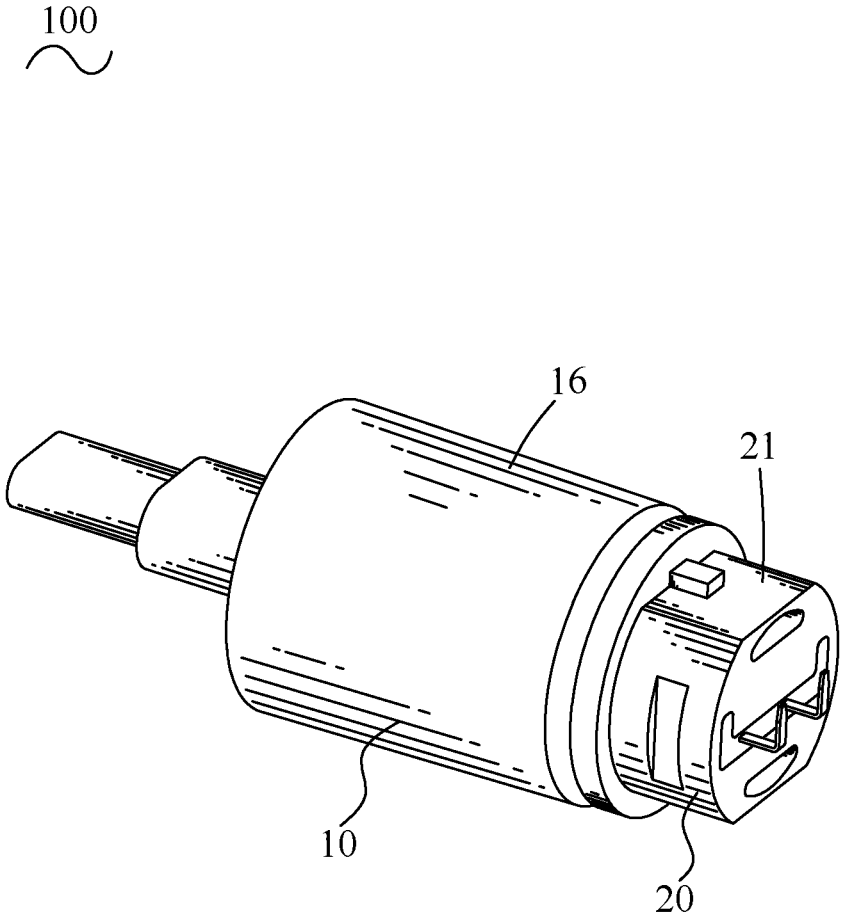
FIG. 1 is a perspective view of an electrical connector assembly in accordance with some embodiments of the present invention, wherein a plug connector and a receptacle connector of the electrical connector assembly are connected to each other.

Referring to FIG. 1, an electrical connector assembly 100 according to some embodiments of the present invention includes a plug connector 10 and a receptacle connector 20.

Figure 2:
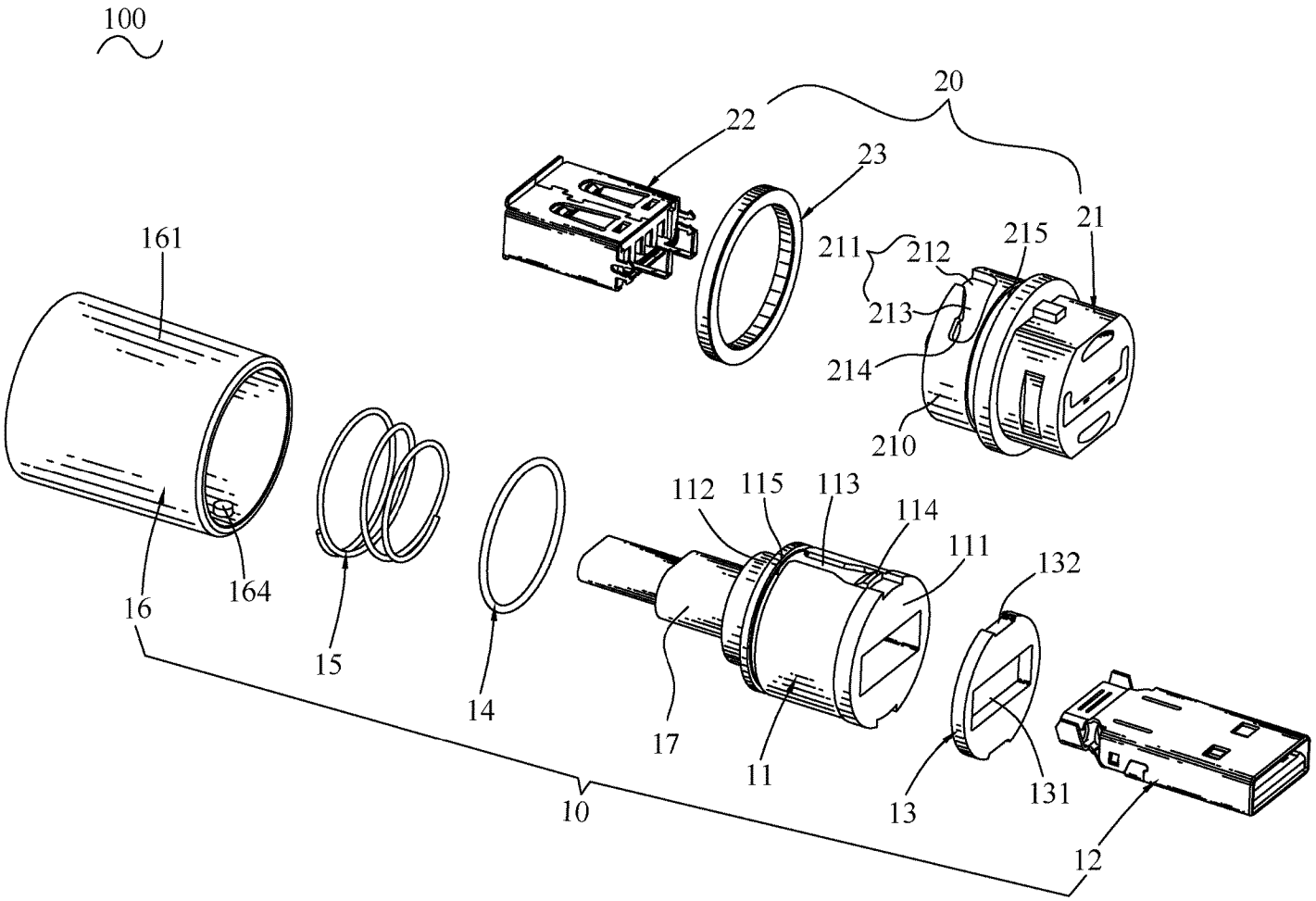
FIG. 2 is an exploded perspective view of the electrical connector assembly of FIG. 1.

Referring to FIG. 1 and FIG. 2, the plug connector 10 includes a first insulating body 11, a first mating port 12, a rubber washer 13, an O ring 14, a spring 15 and a sleeve barrel 16.

Referring to FIG. 2, the first insulating body 11 includes a cylinder shaped base body 111 and an extending portion 112 which is protruded rearward from a middle of a rear surface of the base body 111. An outer periphery of the base body 111 defines a first sliding slot 113 which penetrates a front surface of the base body 111. A stopping portion 114 is extended outward from a front portion of a bottom of the first sliding slot 113. A rear end of the outer periphery of the base body 111 defines a first ring-shaped groove 115 located behind the first sliding slot 113.

Figure 3:
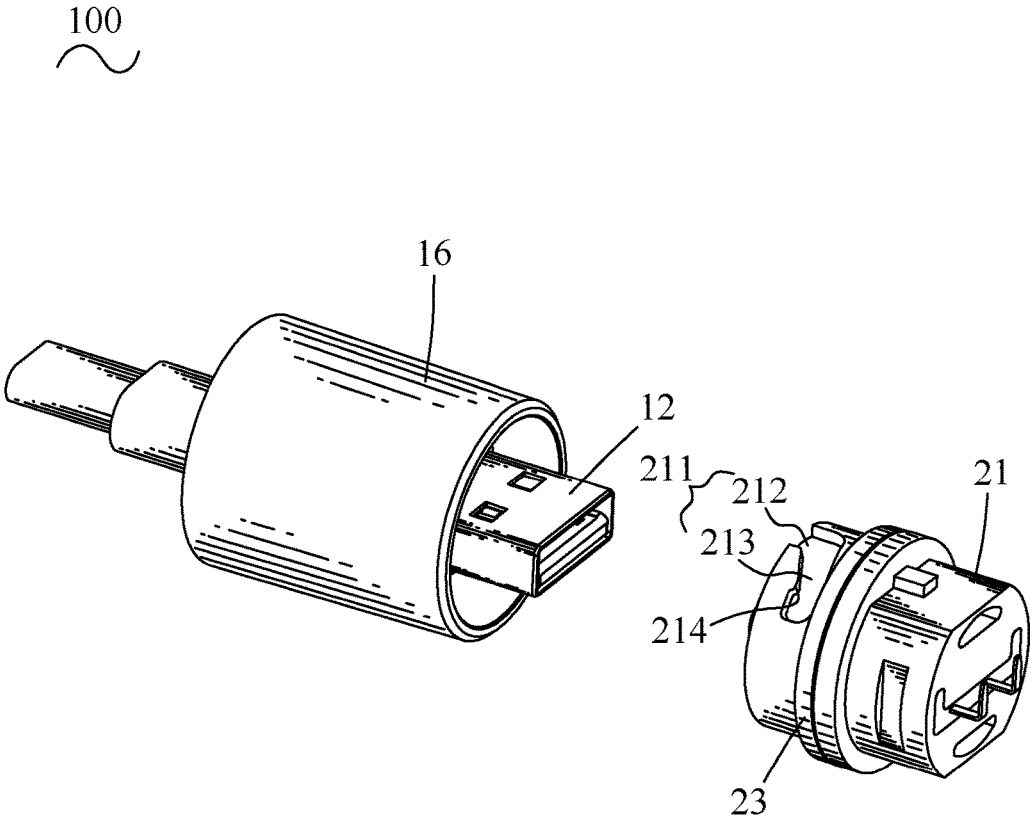
FIG. 3 is a perspective view showing that the plug connector and the receptacle connector of the electrical connector assembly of FIG. 1 are detached with each other.
Figure 4:
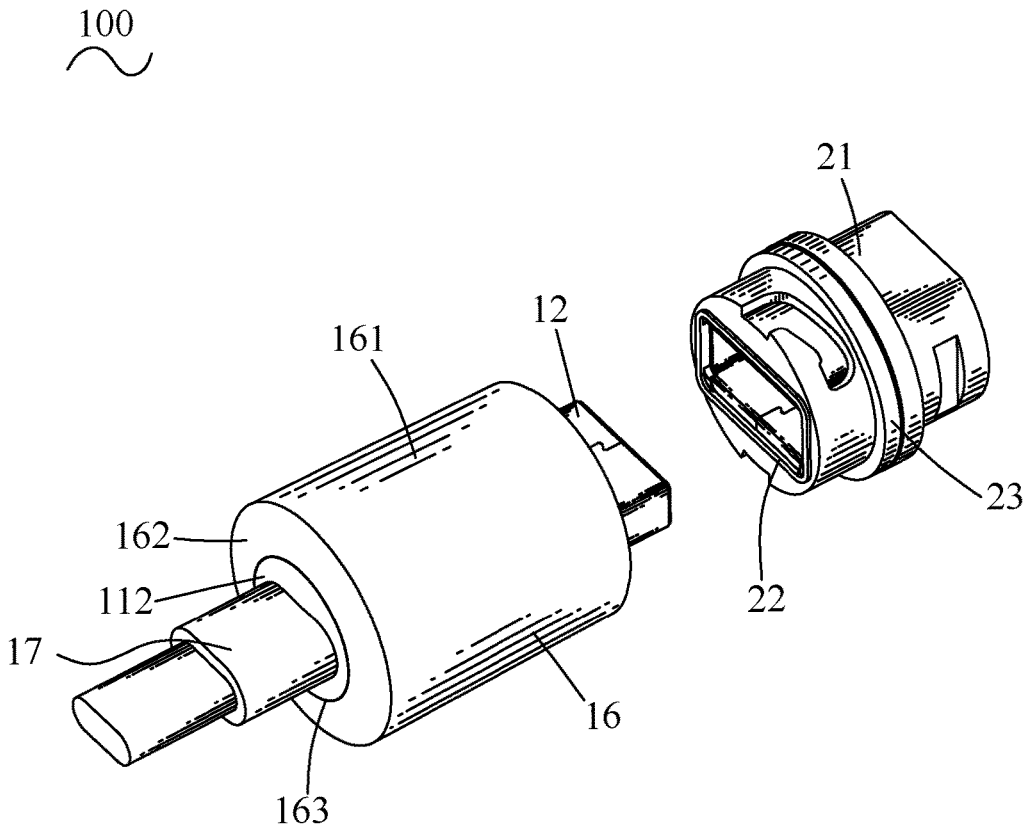
FIG. 4 is another perspective view showing that the plug connector and the receptacle connector of the electrical connector assembly of FIG. 1 are detached with each other.

Referring to FIG. 2 to FIG. 4, an end portion of a cable 17 can be fixed in a rear end of the first mating port 12. When the cable 17 and the first mating port 12 are mounted together, the first insulating body 11 is molded outside the rear end of the first mating port 12 with a front end of the first mating port 12 exposed outside from a front surface of the base body 111 of the first insulating body 11. The cable 17 extends out from the extending portion 112 of the first insulating body 11.

Figure 5:
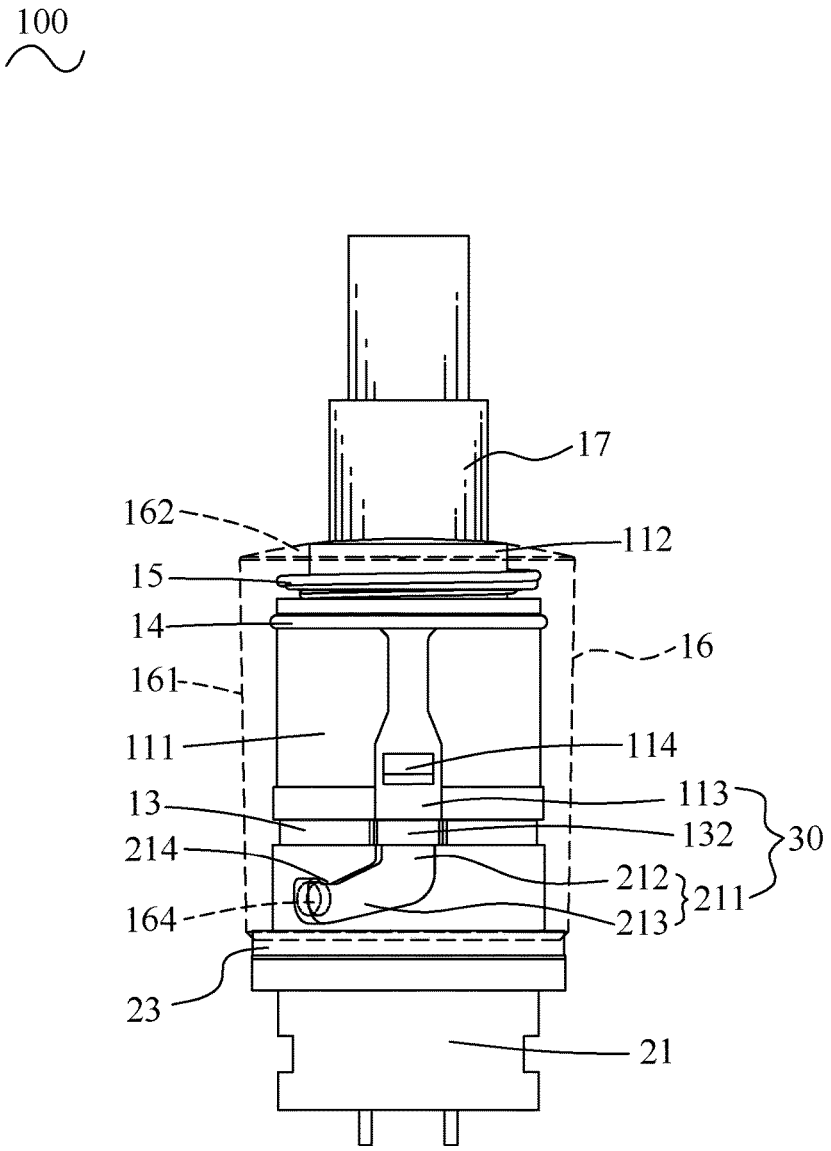
FIG. 5 is a schematic view showing that the plug connector and the receptacle connector of the electrical connector assembly of FIG. 1 are coupled with each other and are locked by a sleeve barrel.

Referring to FIG. 2 and FIG. 5, the rubber washer 13 is mounted on the front surface of the base body 111 of the first insulating body 11 and defines a hole 131 for receiving the first mating portion 12. An outer periphery of the rubber washer 13 defines a connecting groove 132 which connects with the corresponding first sliding slot 113.

Referring to FIG. 2 and FIG. 5, the O ring 14 is mounted in the first ring-shaped groove 115.

Figure 6:
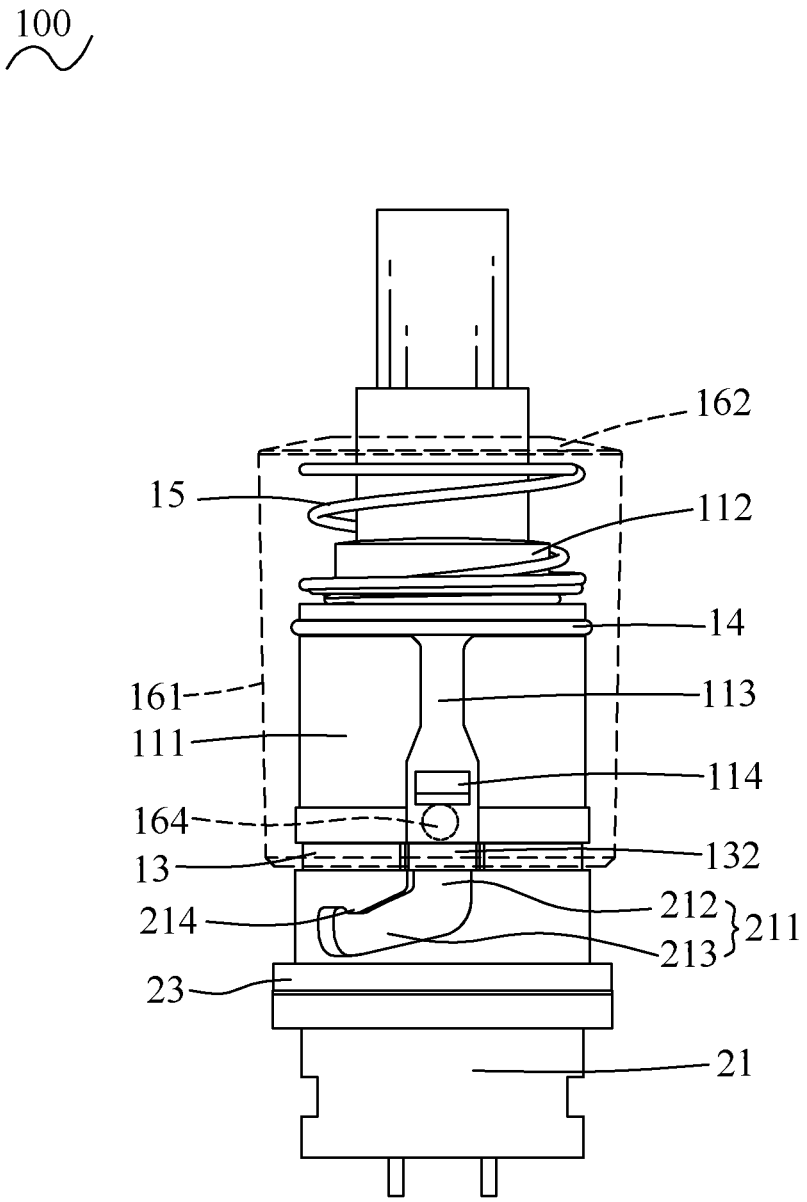
FIG. 6 is another schematic view showing that the plug connector and the receptacle connector of the electrical connector assembly of FIG. 1 are coupled with each other and the sleeve barrel is in an unlocking position.

Referring to FIG. 2, FIG. 5 and FIG. 6, the spring 15 is worn outside the extending portion 112 and one end of the spring 15 abuts against the rear surface of the base body 111.

Referring to FIG. 2, FIG. 4 and FIG. 6, the sleeve barrel 16 includes a barrel body 161 and a barrel end board 162, the barrel end board 162 is arranged at a rear end of the barrel body 161. The barrel end board 162 defines a penetration hole 163. The sleeve barrel 16 is worn outside the first insulating body 11. The extending portion 112 is received in the penetration hole 163. A slider block 164 is protruded from a front portion of an inner surface of the barrel body 161 corresponding to the first sliding slot 113. The slider block 164 slides in the first sliding slot 113 to pass from and be located in front of the stopping portion 114. The other end of the spring 15 abuts against the barrel end board 162. In some embodiments of the present invention, the spring 15 is an approximately truncated cone shape, the one end of the spring 15 which abuts against the rear surface of the base body 111 is narrower than the other end of the spring 15 which abuts against the barrel end board 162.

Referring to FIG. 2, the receptacle connector 20 includes a second insulating body 21, a second mating port 22 and a waterproof ring 23.

Referring to FIG. 2 and FIG. 5, the second insulating body 21 includes a cylinder shaped rear end portion 210 which defines a second sliding slot 211 corresponding to the first sliding slot 113 of the first insulating body 11 and the connecting groove 132 of the rubber washer 13. The second sliding slot 211 includes a longitudinal part 212 with a rear end penetrating a rear surface of the rear end portion 210 and an inclined part 213 extending sideward and inclining frontward from a front end of the longitudinal part 212. A portion of a rear wall of the inclined part 213 protrudes frontward to form a locking portion 214. An outer periphery of the rear end portion 210 of the second insulating body 21 defines a second ring-shaped groove 215 in front of the second sliding slot 211.

Referring to FIG. 4, the second mating port 22 is insert molded in the second insulating body 21 with a rear end thereof exposed from the rear end portion 210 of the second insulating body 21 for mating with the first mating port 12.

Referring to FIG. 3 and FIG. 4, the waterproof ring 23 is mounted in the second ring-shaped groove 213.

Referring to FIG. 2, FIG. 4 and FIG. 5, in use, the first mating port 12 of the plug connector 10 and the second mating port 22 of the receptacle connector 20 are connected with each other while the plug connector 10 and the receptacle connector 20 are being connected with each other, a front surface of the rubber washer 13 contacts with the rear surface of the rear end portion 210 of the second insulating body 21. The first sliding slot 113 of the first insulating body 11, the connecting groove 132 of the rubber washer 13 and the second sliding slot 211 of the second insulating body 21 are connected with each other, so a whole sliding slot 30 is formed. The sleeve barrel 16 of the plug connector 10 moves towards the receptacle connector 20, the slider block 164 of the sleeve barrel 16 moves towards the second sliding slot 211 along the first sliding slot 113 and the connecting groove 132, then, the sleeve barrel 16 is rotated in clockwise direction until the slider block 164 moves to a distal end of the second sliding slot 211. Meanwhile, the spring 15 is compressed by the barrel end board 162, the slider block 164 is locked by the locking portion 214, and a front surface of the barrel body 161 is against the waterproof ring 23 tightly.

Referring to FIG. 2 and FIG. 6, when the plug connector 10 and the receptacle connector 20 is uncoupled, the sleeve barrel 16 is rotated in a counter clockwise direction, then the spring 15 pushes the sleeve barrel 16 move away from the receptacle connector 20, the slider block 164 moves along the second sliding slot 211, the connecting groove 132 and the first sliding slot 113 until the slider block 164 is against a front surface of the stopping portion 114.

As described above, the slider block 164 of the sleeve barrel 16 moves in the first sliding slot 113, the connecting groove 132 and the second sliding slot 211 to lock or unlock the receptacle connector 20. In a locked state, the front surface of the barrel body 161 is against the waterproof ring 23 tightly. The electrical connector assembly 100 not only improves the convenience for the users greatly, but also can prevent water leakage, indeed.

What is claimed is:

1. An electrical connector assembly, comprising:

a plug connector comprising:

a first insulating body including a cylinder shaped base body and an extending portion protruded rearward from a middle of a rear surface of the base body, an outer periphery of the base body defining a first sliding slot penetrating a front surface of the base body, a stopping portion being extended outward from a front portion of a bottom of the first sliding slot;

a sleeve barrel including a barrel body and a barrel end board, the barrel end board being arranged at a rear end of the barrel body, the barrel end board defining a penetration hole, the sleeve barrel being worn outside the first insulating body, the extending portion being received in the penetration hole, a slider block being protruded from a front portion of an inner surface of the barrel body corresponding to the first sliding slot, the slider block capable of sliding in the first sliding slot to pass from and be located in front of the stopping portion;

a spring worn outside the extending portion, one end of the spring abutting against a rear surface of the base body, the other end of the spring abutting against the barrel end board; and a receptacle connector comprising:

a second insulating body including a cylinder shaped rear end portion which defines a second sliding slot corresponding to the first sliding slot of the first insulating body, the second sliding slot including a longitudinal part with a rear end penetrating a rear surface of the rear end portion and an inclined part extending sideward and inclining frontward from a front end of the longitudinal part;

wherein the first sliding slot of the first insulating body and the second sliding slot of the second insulating body are connected to each other, the sleeve barrel moves towards the receptacle connector, the slider block of the sleeve barrel moves towards the second sliding slot, the sleeve barrel is rotated in clockwise direction until the slider block is locked in a distal end of the second sliding slot, and the spring is compressed by the barrel end board.

2. The electrical connector assembly as claimed in claim 1, wherein a rear end of the outer periphery of the base body defines a first ring-shaped groove, and the plug connector further comprises an O ring mounted in the first ring-shaped groove.

3. The electrical connector assembly as claimed in claim 1, wherein the spring is an approximately truncated cone shape, and the one end of the spring which abuts against the rear surface of the base body is narrower than the other end of the spring which abuts against the barrel end board.

4. The electrical connector assembly as claimed in claim 1, wherein the plug connector further includes a rubber washer mounted on the front surface of the base body, and an outer periphery of the rubber washer defines a connecting groove which connects with the first sliding slot and the second sliding slot.

5. The electrical connector assembly as claimed in claim 1, wherein a portion of a rear wall of the inclined part protrudes frontward to form a locking portion.

6. The electrical connector assembly as claimed in claim 1, further comprising a waterproof ring mounted on the rear end portion of the second insulating body and located in front of the second sliding slot, when the slider block is locked in the distal end of the second sliding slot, a front surface of the barrel body is against the waterproof ring.

7. The electrical connector assembly as claimed in claim 6, wherein an outer periphery of the rear end portion defines a second ring-shaped groove in front of the second sliding slot for mounting a waterproof ring therein.

8. The electrical connector assembly as claimed in claim 1, wherein the plug connector further comprises a first mating port, the first insulating body is molded outside the first mating port with a front end of the first mating port exposed frontward, and the receptacle connector further comprises a second mating port insert molded in the second insulating body with a rear end thereof exposed from the rear end portion of the second insulating body for mating with the first mating port.

9. The electrical connector assembly as claimed in claim 8, wherein the plug connector further comprises a cable, an end portion of a cable is mounted in a rear end of the first mating port, and the cable extends out from the extending portion of the first insulating body.

10. The electrical connector assembly as claimed in claim 8, wherein the first insulating body is molded outside a rear end of the first mating port with the front end of the first mating port exposed outside from a front surface of the base body of the first insulating body.

11. The electrical connector assembly as claimed in claim 10, wherein the plug connector further includes a rubber washer mounted on the front surface of the base body, an outer periphery of the rubber washer defines a connecting groove which connects with the first sliding slot and the second sliding slot, and the rubber washer defines a hole for receiving the first mating port.

12. A plug connector, comprising:

a first insulating body including a cylinder shaped base body and an extending portion protruded rearward from a middle of a rear surface of the base body, an outer periphery of the base body defining a first sliding slot penetrating a front surface of the base body, a stopping portion being extended outward from a front portion of a bottom of the first sliding slot;

a sleeve barrel including a barrel body and a barrel end board, the barrel end board being arranged at a rear end of the barrel body, the barrel end board defining a penetration hole, the sleeve barrel being worn outside the first insulating body, the extending portion being received in the penetration hole, a slider block being protruded from a front portion of an inner surface of the barrel body corresponding to the first sliding slot, the slider block capable of sliding in the first sliding slot to pass from and be located in front of the stopping portion;

a spring worn outside the extending portion, one end of the spring abutting against a rear surface of the base body, the other end of the spring abutting against the barrel end board;

wherein the spring is an approximately truncated cone shape, and the one end of the spring which abuts against the rear surface of the base body is narrower than the other end of the spring which abuts against the barrel end board.

13. The plug connector as claimed in claim 12, wherein a rear end of the outer periphery of the base body defines a first ring-shaped groove, and the plug connector further comprises an O ring mounted in the first ring-shaped groove.

14. The plug connector as claimed in claim 12, further comprising a rubber washer mounted on the front surface of the base body, an outer periphery of the rubber washer defining a connecting groove which connects with the first sliding slot.

15. The plug connector as claimed in claim 12, further comprising a first mating port, the first insulating body being molded outside the first mating port with a front end of the first mating port exposed frontward.

16. The plug connector as claimed in claim 15, further comprising a cable, an end portion of a cable being mounted in a rear end of the first mating port, the cable extending out from the extending portion of the first insulating body.

17. The plug connector as claimed in claim 15, further comprising a rubber washer mounted on the front surface of the base body, an outer periphery of the rubber washer defining a connecting groove which connects with the first sliding slot, the rubber washer defining a hole for receiving the first mating portion.

* * * * *